US005499613A

United States Patent [19]

Bayerle et al.

[11] Patent Number: 5,499,613

[45] Date of Patent: Mar. 19, 1996

[54] METHOD FOR MONITORING A TANK VENTING SYSTEM THAT TRAPS FUEL VAPORS AND FEEDS THEM TO AN INTERNAL COMBUSTION ENGINE

[75] Inventors: Klaus Bayerle; Hartmut Pfleger, both of Regensburg, Germany

[73] Assignee: Siemens Aktiengesellschaft, Munich, Germany

[21] Appl. No.: 278,272

[22] Filed: Jul. 21, 1994

[30] Foreign Application Priority Data

Jul. 21, 1993 [EP] European Pat. Off. ..... 93111691

[51] Int. Cl.[6] ..... F02M 33/02

[52] U.S. Cl. ..... 123/520

[58] Field of Search ..... 123/518, 519, 123/520, 198 D

[56] References Cited

U.S. PATENT DOCUMENTS

| | | | |
|---|---|---|---|
| 4,949,695 | 8/1990 | Uranishi et al. | 123/520 |
| 5,146,902 | 9/1992 | Cook et al. | 123/520 |
| 5,191,870 | 3/1993 | Cook | 123/520 |
| 5,205,263 | 4/1993 | Blumenstock et al. | 123/520 |
| 5,261,379 | 11/1993 | Lipinski et al. | 123/520 |
| 5,315,980 | 5/1994 | Otsuka et al. | 123/520 |
| 5,333,589 | 8/1994 | Otsuka | 123/520 |
| 5,333,590 | 8/1994 | Thompson | 123/520 |
| 5,345,917 | 9/1994 | Maruyama et al. | 123/520 |
| 5,347,971 | 9/1994 | Kobayashi et al. | 123/520 |
| 5,355,864 | 10/1994 | Kuroda et al. | 123/520 |

FOREIGN PATENT DOCUMENTS

| | | |
|---|---|---|
| 0527523 | 2/1993 | European Pat. Off. . |
| 4030948 | 10/1991 | Germany . |
| 2254318 | 10/1992 | United Kingdom . |
| 9112426 | 8/1991 | WIPO . |
| 9116216 | 10/1991 | WIPO . |
| 9302283 | 2/1993 | WIPO . |

*Primary Examiner*—Thomas N. Moulis
*Attorney, Agent, or Firm*—Herbert L. Lerner; Laurence A. Greenberg

[57] ABSTRACT

A tank venting system for trapping fuel vapors and feeding the fuel vapors to an internal combustion engine having a fuel tank and an intake tube, includes a container adsorbing fuel vapors. A venting line is connected between the fuel tank and the container. A regeneration line is connected between the container and the intake tube of the internal combustion engine. A ventilation line communicates with the atmosphere and the container. A ventilation valve closes the ventilation line. A tank venting valve is disposed in the regeneration line and is triggered in an opening direction for feeding fuel vapors stored in the container. A pressure sensor detects a system pressure of the tank venting system. A method for monitoring the tank venting system includes monitoring the system pressure with the pressure sensor during the feeding of the fuel vapors, categorizing the ventilation valve as functioning improperly if a predetermined pressure threshold value is exceeded, and closing the tank venting valve.

2 Claims, 1 Drawing Sheet

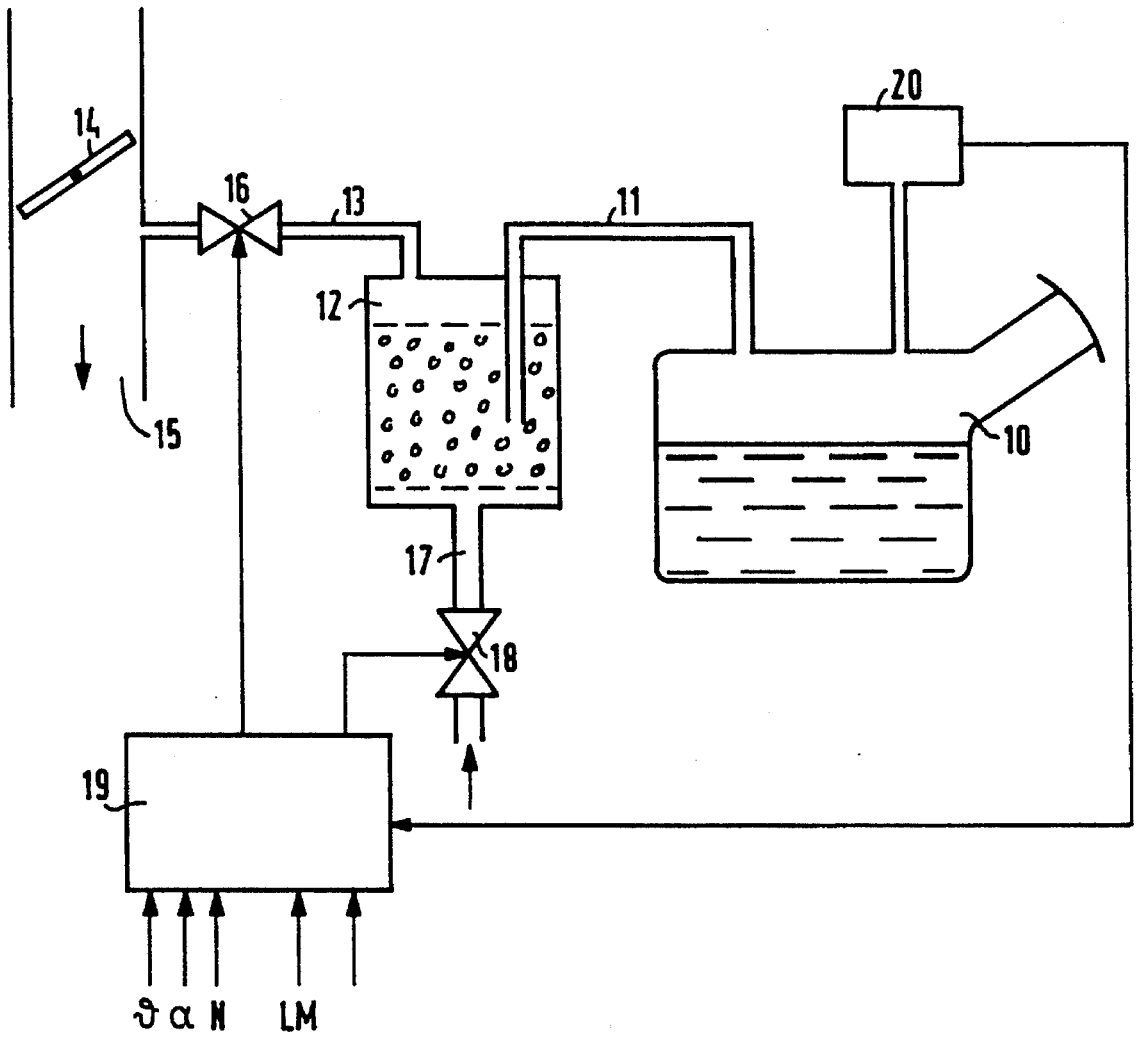
20
14
16
13
11
12
15
10
17
18
19
ϑ α N LM

METHOD FOR MONITORING A TANK VENTING SYSTEM THAT TRAPS FUEL VAPORS AND FEEDS THEM TO AN INTERNAL COMBUSTION ENGINE

BACKGROUND OF THE INVENTION

1. Field of the Invention

The invention relates to a method for monitoring a tank venting system for trapping fuel vapors and feeding the fuel vapors to an internal combustion engine having a fuel tank and an intake tube, wherein the tank venting system includes a container adsorbing fuel vapors, a venting line connected between the fuel tank and the container, a regeneration line connected between the container and the intake tube of the internal combustion engine, a ventilation line communicating with the atmosphere and the container, a ventilation valve for closing the ventilation line, a tank venting valve being disposed in the regeneration line and being triggered in an opening direction for feeding fuel vapors stored in the container, and a pressure sensor detecting a system pressure of the tank venting system.

The purpose of such a tank venting system which is known, for instance, from German Published, Non-Prosecuted Application DE 40 03 751 A1, corresponding to Published International Application WO 91/12426 and U.S. Pat. No. 5,193,512, is to prevent hydrocarbons from evaporating out of the fuel into the atmosphere.

To that end, the tank venting system has a fuel tank and a tank venting valve that communicates with the engine intake tube, so that with the aid of the negative pressure prevailing there, the fuel vapors can be extracted by suction out of a container located between the tank and the tank venting valve during certain operating states. To that end, a ventilation line, mounted on the bottom of the container filled with the activated charcoal filter, is provided with a controllable shutoff valve (ventilation valve). The activated charcoal filter located in the container adsorbs fuel during periods in which no extraction by suction from the intake tube takes place.

Due to the danger in such tank venting systems that some parts of it may leak, or that the tank venting valve may not function properly, the tank venting system must be repeatedly checked for functional capability during vehicle operation.

In order to check the tightness or leakproofness of the system, the ventilation valve is closed, and a pressure sensor, mounted in the fuel tank, for instance, measures whether or not the requisite negative pressure for checking has built up in the tank. If so, the conclusion is drawn that the system can function.

However, the pressure sensor may also be disposed at some other point of the tank venting system, such as in the line between the tank venting valve and the activated charcoal container, or in the line between the activated charcoal container and the fuel tank, or in the ventilation line upstream of the ventilation valve.

In order to prevent an overly high or an overly low pressure from building up in the tank venting system if the ventilation valve is not functioning properly, the system of German Published, Non-Prosecuted Application DE 40 03 751 A1, corresponding to Published International Application WO 91/12426 and U.S. Pat. No. 5,193,512 is provided with a mechanical protection valve assembly in the ventilation line. That mechanical protection valve assembly has an overpressure protection valve and a negative pressure protection valve, and the pressures of the valve assembly are adjusted in such a way that there is no danger of damage to the tank venting system from overly high or overly low pressures.

That apparatus has the disadvantage of requiring not only the ventilation valve and the tank venting valve but also additional mechanical valves in the lines.

SUMMARY OF THE INVENTION

It is accordingly an object of the invention to provide a method for monitoring a tank venting system that traps fuel vapors and feeds them to an internal combustion engine, which overcomes the hereinafore-mentioned disadvantages of the heretofore-known methods of this general type, which uses only the components already present in the tank venting system and which provides a simple way of assuring that destruction of parts of the tank venting system will be avoided if the ventilation valve is malfunctioning.

With the foregoing and other objects in view there is provided, in accordance with the invention, in a method for monitoring a tank venting system for trapping fuel vapors and feeding the fuel vapors to an internal combustion engine having a fuel tank and an intake tube, wherein the tank venting system includes a container adsorbing fuel vapors, a venting line connected between the fuel tank and the container, a regeneration line connected between the container and the intake tube of the internal combustion engine, a ventilation line communicating with the atmosphere and the container, a ventilation valve for closing the ventilation line, a tank venting valve being disposed in the regeneration line and being triggered in an opening direction for feeding fuel vapors stored in the container, and a pressure sensor detecting a system pressure of the tank venting system, the improvement which comprises monitoring the system pressure with the pressure sensor during the feeding of the fuel vapors; categorizing the ventilation valve as functioning improperly if a predetermined pressure threshold value is exceeded; and closing the tank venting valve.

In accordance with a concomitant mode of the invention, there is provided a method which comprises starting a time counter if the threshold value is exceeded; and closing the tank venting valve if a predeterminable final counter value is attained.

Damage to the fuel tank or other components of the tank venting system can be reliably prevented by utilizing and evaluating signals of the pressure sensor, which already exists in such tank venting systems for checking the tightness of the lines and valves, in order to also limit the negative pressure if the ventilation valve is malfunctioning.

If the negative pressure in the tank venting system during the regeneration process exceeds a predeterminable threshold value, then the tank venting valve is closed, or in other words the communication with the engine intake tube is interrupted, and the negative pressure in the intake tube cannot cause any damage to parts of the tank venting system.

Other features which are considered as characteristic for the invention are set forth in the appended claims.

Although the invention is illustrated and described herein as embodied in a method for monitoring a tank venting system that traps fuel vapors and feeds them to an internal combustion engine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the single figure of the drawing.

BRIEF DESCRIPTION OF THE DRAWING:

The FIGURE of the drawing is a diagrammatic and schematic illustration of a tank venting system for an internal combustion engine, showing only those parts which are necessary for an understanding of the invention.

DESCRIPTION OF THE PREFERRED EMBODIMENTS:

Referring now to the single FIGURE of the drawing in detail, it is seen that reference numeral 10 indicates a fuel tank having a filling neck which is closed in airtight fashion by a non-illustrated tank lid. The fuel tank 10 communicates through a venting line 11 with an activated charcoal container 12, in which hydrocarbon vapors outgassing from the fuel tank 10 are adsorbed. A regeneration line 13 begins at the activated charcoal container 12 and discharges downstream of a throttle valve 14 into an intake tube 15 of an engine. A flow control valve, which is referred to below as a tank venting valve 16, is disposed in the regeneration line 13. A ventilation line 17, which is provided on the underside of the activated charcoal container 12, communicates with the ambient air and can be shut off by means of an electromagnetic valve, which is referred to below as a ventilation valve 18. Both this ventilation valve 18 and the tank venting valve 16 are connected through electrical lines to an electronic control unit 19 of the engine. A pressure sensor 20 is also connected to the control unit 19 through an electric line. The pressure sensor 20 is disposed either on an upper part of a side wall or on an upper part of the fuel tank 10 and outputs a signal corresponding to the pressure in the fuel tank. Other control parameters that are needed for engine operation, such as the rpm N, the coolant temperature $\sigma$, the throttle valve angle $\alpha$, and the air mass or flow rate LM are also supplied to the control unit 19.

The load state of the engine is detected in the control unit 19 through the use of these parameters. These parameters are processed further in such a way that scavenging of the activated charcoal container 12 or a check of the tank venting system can be initiated, as needed.

Regeneration of the activated charcoal filter in the container 12 is preferably carried out in partial-load operation of the engine. To that end, the tank venting valve 16 is triggered (opened) through the control unit 19, so that the negative pressure that prevails in the intake tube 15, and that is dependent on the position of the throttle valve 14, progresses into the activated charcoal container 12 through the tank venting valve 16. Ambient air flows through the likewise-opened ventilation valve 18 into the activated charcoal container 12, and the fuel vapors adsorbed by the filter are supplied to the engine intake tube 15. As a result, the activated charcoal is regenerated.

When the engine is off, or in phases of operation in which the tank venting valve 16 is also closed, the activated charcoal is then again able to receive fuel vapor.

In order to check the function of the tank venting system, and in particular to check whether or not the pipelines and valves are tight, the tank venting valve 16 is opened and the ventilation valve 18 is closed through the control unit 19, during engine operation and when the instantaneous load state permits. As a result, the negative pressure present in the intake tube 15 downstream of the throttle valve 14 builds up in the activated charcoal container 12 through the regeneration line 13, and progresses through the venting line 11 into the fuel tank 10.

A finding as to the functional capability of the tank venting system is then obtained in a known manner by evaluating the signals furnished by the pressure sensor 20.

If a regeneration operation is initiated after diagnosis of the tank venting system in which the ventilation valve 18 was closed, then the ventilation valve 18 may no longer open and the defect goes undetected. This may involve a mechanical defect of the ventilation valve 18 (seizing) and/or an electrical defect.

In either case, a danger then exists of the negative pressure in the intake tube 15 progressing through the regeneration line 13, the activated charcoal container 12 and the venting line 11 into the fuel tank 10, and causing destruction of the fuel tank 10 or the fuel pump.

In order to avoid such an occurrence, the pressure sensor, which is present in any case for the diagnosis of tightness of the tank venting system, is utilized. If the negative pressure in the fuel tank 10 exceeds a predeterminable value during the regeneration process, then the tank venting valve 16 is closed through the control unit 19, and the communication with the intake tube 15 is thus broken.

In order to avert premature shutoff of the tank venting valve 16 by mistake, this valve may not be closed immediately the first time that the maximum value of the pressure in the fuel tank 10 is exceeded, but rather only after the detected pressure has stayed above this maximum pressure for a predetermined, selectable period of time.

Ventilation valve malfunction can also be indicated to the driver directly, through an acoustical and/or visual display device, or else these deficiencies can be stored in a diagnostic memory in the control unit 19 and read out by a stationary diagnostic unit during vehicle maintenance. This can be suitably achieved by a pressure sensor either in the form of a differential pressure sensor which measures the differential pressure in the fuel tank relative to the atmospheric pressure, or in the form of an absolute-value pressure sensor.

We claim:

1. In a method for monitoring a tank venting system for trapping fuel vapors and feeding the fuel vapors to an internal combustion engine having a fuel tank and an intake tube, wherein the tank venting system includes:

a container adsorbing fuel vapors, a venting line connected between the fuel tank and the container, a regeneration line connected between the container and the intake tube of the internal combustion engine, a ventilation line communicating with the atmosphere and the container, a ventilation valve for closing the ventilation line, a tank venting valve being disposed in the regeneration line and being triggered in an opening direction for feeding fuel vapors stored in the container, and a pressure sensor detecting a system pressure of the tank venting system, the improvement which comprises:

monitoring the system pressure with the pressure sensor during the feeding of the fuel vapors;

categorizing the ventilation valve as functioning improperly if the system pressure determined in the monitoring step exceeds a predetermined pressure threshold value; and closing the tank venting valve.

2. The method according to claim 1, which comprises starting a time counter if the threshold value is exceeded; and closing the tank venting valve if a predeterminable final counter value is attained.

* * * * *